US011994310B2

(12) United States Patent
Tanaka

(10) Patent No.: US 11,994,310 B2
(45) Date of Patent: May 28, 2024

(54) AIR-CONDITIONING SYSTEM

(71) Applicant: Mitsubishi Electric Corporation, Tokyo (JP)

(72) Inventor: Yasuhiko Tanaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 926 days.

(21) Appl. No.: 16/981,012

(22) PCT Filed: May 7, 2018

(86) PCT No.: PCT/JP2018/017632
§ 371 (c)(1),
(2) Date: Sep. 15, 2020

(87) PCT Pub. No.: WO2019/215784
PCT Pub. Date: Nov. 14, 2019

(65) Prior Publication Data

US 2021/0302047 A1 Sep. 30, 2021

(51) Int. Cl.
*F24F 11/56* (2018.01)
*F24F 1/0007* (2019.01)
(Continued)

(52) U.S. Cl.
CPC ..... *F24F 11/56* (2018.01); *F24F 1/0007* (2013.01); *F24F 11/54* (2018.01); *F24F 11/88* (2018.01)

(58) Field of Classification Search
CPC . F24F 11/56; F24F 11/54; H04W 4/80; G05B 15/02
See application file for complete search history.

(56) References Cited

U.S. PATENT DOCUMENTS 5,853,123 A 12/1998 Okano et al.
2016/0131387 A1* 5/2016 Sawada ..... F24F 11/46 62/158
2018/0266720 A1* 9/2018 Lee ..... G05B 15/02

FOREIGN PATENT DOCUMENTS

DE 695 32 759 T2 8/2004
EP 1 936 294 B1 7/2013
(Continued)

OTHER PUBLICATIONS

International Search Report of the International Searching Authority dated Jul. 3, 2018 for the corresponding international application No. PCT/JP2018/017632 (and English translation).
(Continued)

*Primary Examiner* — Vernal U Brown
(74) *Attorney, Agent, or Firm* — POSZ LAW GROUP, PLC

(57) ABSTRACT

An air-conditioning system includes a plurality of air-conditioning apparatuses each including an outdoor unit, an indoor unit, and a remote controller and a transmission line via which the plurality of air-conditioning apparatuses are connected to each other. Each of the outdoor units includes a communication unit configured to transmit and receive a signal and a repeater configured to relay a signal of a set frequency. In a case where a set frequency with which the repeater of one air-conditioning apparatus of the plurality of air-conditioning apparatuses is compatible and a set frequency with which the repeater of the other air-conditioning apparatus of the plurality of air-conditioning apparatuses is compatible match, the remote controller of the one air-conditioning apparatus and the indoor unit of the other air-conditioning apparatus is configured to perform communication by use of a signal of the set frequency thus matching.

6 Claims, 7 Drawing Sheets

(51) Int. Cl.
*F24F 11/54* (2018.01)
*F24F 11/88* (2018.01)

(56) References Cited

FOREIGN PATENT DOCUMENTS

| | | | |
|---|---|---|---|
| JP | H05-187697 | A | 7/1993 |
| JP | 2004-221905 | A | 8/2004 |
| JP | 2005-311663 | A | 11/2005 |
| JP | 2011-145014 | A | 7/2011 |
| JP | 2012-077970 | A | 4/2012 |
| JP | 2014-150386 | A | 8/2014 |
| JP | 2014-105966 | A | 9/2014 |

OTHER PUBLICATIONS

Office Action dated Jan. 26, 2023 issued in corresponding DE Patent Application No. 112018007573.7 (and English translation).

* cited by examiner

Comparative Example

AIR-CONDITIONING SYSTEM

CROSS REFERENCE TO RELATED APPLICATION

This application is a U.S. national stage application of PCT/JP2018/017632 filed on May 7, 2018, the contents of which are incorporated herein by reference.

TECHNICAL FIELD

The present disclosure relates to an air-conditioning system configured to perform communication between a plurality of air-conditioning apparatuses.

BACKGROUND ART

In some air-conditioning system composed of a plurality of pieces of facility equipment such as outdoor units and indoor units, the pieces of facility equipment are connected to each other by a transmission line (see, for example, Patent Literature 1). In the air-conditioning system described in Patent Literature 1, the outdoor units of a plurality of respective air-conditioning apparatuses are connected to each other through a transmission line for use in communication and perform communication with each other via the transmission line. This allows the air-conditioning apparatuses to perform air conditioning in conjunction with each other.

In a case where air-conditioning apparatuses are connected to each other through a transmission line to perform communication, a repeater is usually installed on a communication path formed by the transmission line for the purpose of extending a transmission distance and shaping a signal on which noise is superimposed.

CITATION LIST

Patent Literature

Patent Literature 1: Japanese Unexamined Patent Application Publication No. 2014-105966

SUMMARY OF INVENTION

Technical Problem

Incidentally, for example, in a case where at least one air-conditioning apparatus is replaced in some air-conditioning system, air-conditioning apparatuses employing different communication methods may perform communication with each other via a transmission line. In this case, the communication is usually designed in such a manner that upward compatibility is ensured and an inferior communication method can be handled by a superior communication method. That is, in a case where both apparatuses are compatible with the superior communication method, the superior communication method is used to perform communication. On the other hand, in a case where either apparatus is incompatible with the superior communication method, the inferior communication method, which is a standard communication method, is used to perform communication.

However, in this case, it is impossible to determine which communication method can be used to perform optimum communication, as there is a mixture of communication methods that are separately employed by air-conditioning apparatuses. This makes it necessary to use a standard communication method to surely perform communication between air-conditioning apparatuses, making it impossible to bring about improvement, for example, in communication rate.

The present disclosure has been made in view of the foregoing problems and has an object to provide an air-conditioning system configured to properly perform communication even in a case where there is a mixture of apparatuses that are different in communication method from each other.

Solution to Problem

An air-conditioning system according to an embodiment of the present disclosure is an air-conditioning system including a plurality of air-conditioning apparatuses each including an outdoor unit, an indoor unit, and a remote controller; and a transmission line via which the plurality of air-conditioning apparatuses are connected to each other. Each of the outdoor units includes a communication unit configured to transmit and receive a signal, and a repeater configured to relay a signal of a set frequency, and in a case where a set frequency with which the repeater of one air-conditioning apparatus of the plurality of air-conditioning apparatuses is compatible and a set frequency with which the repeater of the other air-conditioning apparatus of the plurality of air-conditioning apparatuses is compatible match, the remote controller of the one air-conditioning apparatus and the indoor unit of the other air-conditioning apparatus is configured to perform communication by use of a signal of the set frequency thus matching.

Advantageous Effects of Invention

According to an embodiment of the present disclosure, in a case where a set frequency with which the repeater of one air-conditioning apparatus of the plurality of air-conditioning apparatuses is compatible and a set frequency with which the repeater of the other air-conditioning apparatus of the plurality of air-conditioning apparatuses is compatible match, communication is performed by use of a signal of the set frequency thus matching. This makes it possible to properly perform communication even in a case where there is a mixture of apparatuses that are different in communication method from each other.

DESCRIPTION OF EMBODIMENTS

Embodiment 1

The following describes an air-conditioning system according to Embodiment 1 of the present disclosure. The air-conditioning system according to Embodiment 1 is designed in such a manner that a plurality of air-conditioning apparatuses that are different in communication method from each other transmit and receive a signal to and from each other.

[Configuration of Air-Conditioning System 100]

Figure 1:
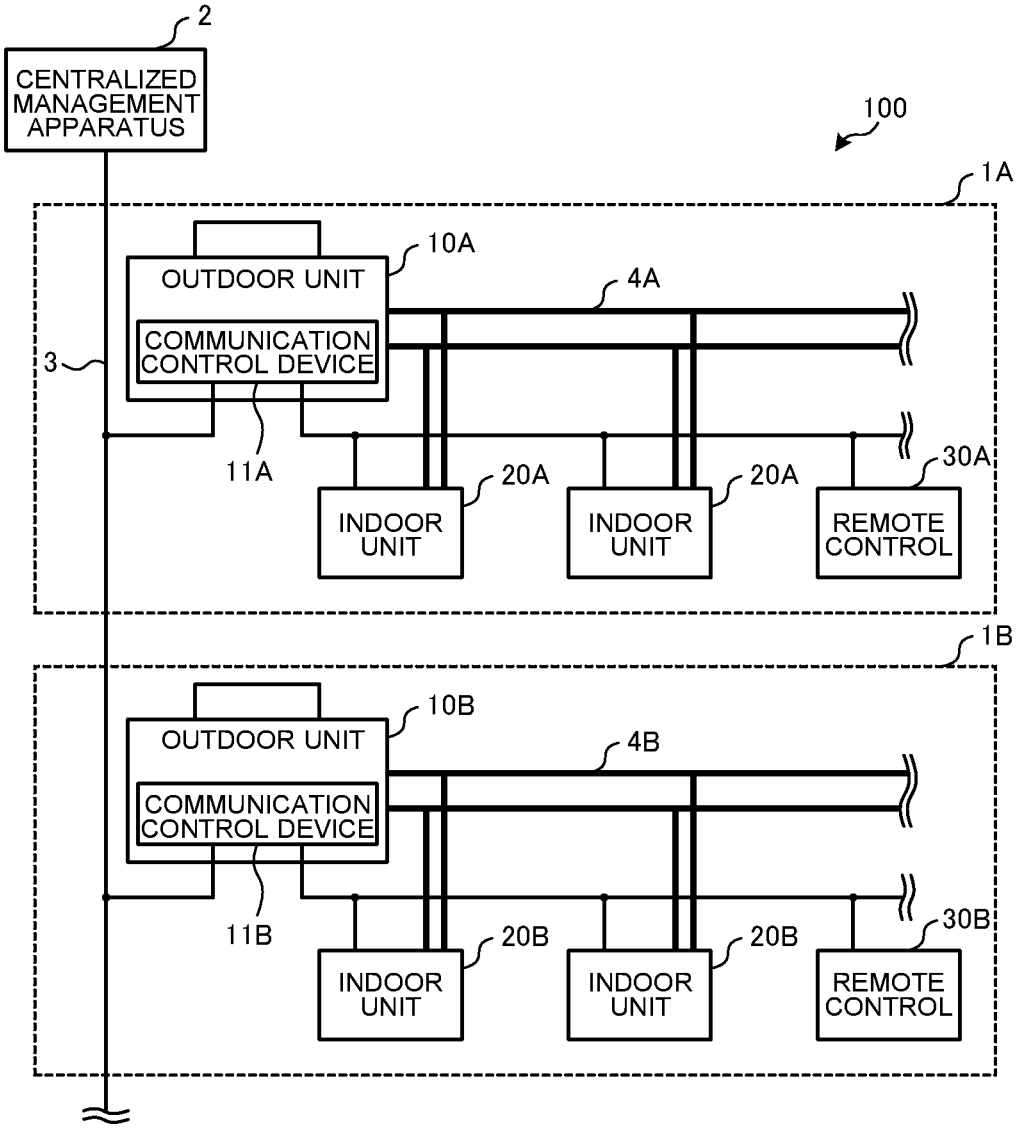
FIG. 1 is a block diagram showing an example of a configuration of an air-conditioning system according to Embodiment 1.

FIG. 1 is a block diagram showing an example of a configuration of an air-conditioning system 100 according to Embodiment 1. As shown in FIG. 1, the air-conditioning system 100 is composed of a plurality of air-conditioning apparatuses 1A and 1B and a centralized management apparatus 2. In the example shown in FIG. 1, the air-conditioning system 100 is provided with the two air-conditioning apparatuses 1A and 1B. However, this is not intended to impose any limitation. The air-conditioning system 100 may be provided with three or more air-conditioning apparatuses.

The plurality of air-conditioning apparatuses 1A and 1B and the centralized management apparatus 2 are connected to each other by a dedicated transmission line 3. The transmission line 3 is a signal carrier medium for the plurality of air-conditioning apparatuses 1A and 11B and the centralized management apparatus 2 to perform communication with each other in conformity to a communication protocol unique to the air-conditioning system 100.

(Centralized Management Apparatus 2)

The centralized management apparatus 2 performs management and control of the air-conditioning apparatuses 1A and 1B by transmitting and receiving various types of data to and from the air-conditioning apparatuses 1A and 1B via the transmission line 3. For example, the centralized management apparatus 2 receives information indicating states of the air-conditioning apparatuses 1A and 1B and transmits, via the transmission line 3, control signals for controlling the air-conditioning apparatuses 1A and 1B.

(Air-Conditioning Apparatuses 1A and 1B)

The air-conditioning apparatuses 1A and 1B receive, via the transmission line 3, control signals, transmitted from the centralized management apparatus 2, that contain control instructions, and perform air-conditioning operation on the basis of the control signals thus received. Further, during operation, the air-conditioning apparatuses 1A and 1B transmit, to the centralized management apparatus 2, signals containing data needed for the centralized management apparatus 2 to exercise control.

The air-conditioning apparatus 1A includes an outdoor unit 10A, an indoor unit 20A, and a remote controller (hereinafter referred to as "remote control") 30A. In the example shown in FIG. 1, the air-conditioning apparatus 1A includes one outdoor unit 10A, two indoor units 20A, and one remote control 30A. The outdoor unit 10A and the indoor units 20A are connected to each other through refrigerant pipes 4A, whereby a refrigerant circuit is formed. Usable examples of refrigerant that circulates through the refrigerant circuit include R32, R410A, or other refrigerants.

The air-conditioning apparatus 1B includes an outdoor unit 10B, an indoor unit 20B, and a remote control 30B. In the example shown in FIG. 1, the air-conditioning apparatus 1B includes one outdoor unit 10B, two indoor units 20B, and one remote control 30B. The outdoor unit 10B and the indoor units 20B are connected to each other through refrigerant pipes 4B, whereby a refrigerant circuit is formed.

In each of the air-conditioning apparatuses 1A and 1B, the numbers of outdoor units 10A and 10B, the numbers of indoor units 20A and 20B, and the numbers of remote controls 30A and 30B are not limited to this example but may be any numbers. Further, the air-conditioning apparatuses 1A and 1B do not need to be identical in configuration but may be different in configuration from each other, so that the numbers of pieces of equipment are different.

(Outdoor Units 10A and 10B)

The outdoor unit 10A includes a communication control device 11A. The outdoor unit 10B includes a communication control device 11B. The communication control devices 11A and 11B control communication that is performed among the centralized management apparatus 2 and the air-conditioning apparatuses 1A and 1B, which are connected to each other through the transmission line 3, and control communication that is performed among the pieces of facility equipment in the air-conditioning apparatuses 1A and 1B.

Figure 2:
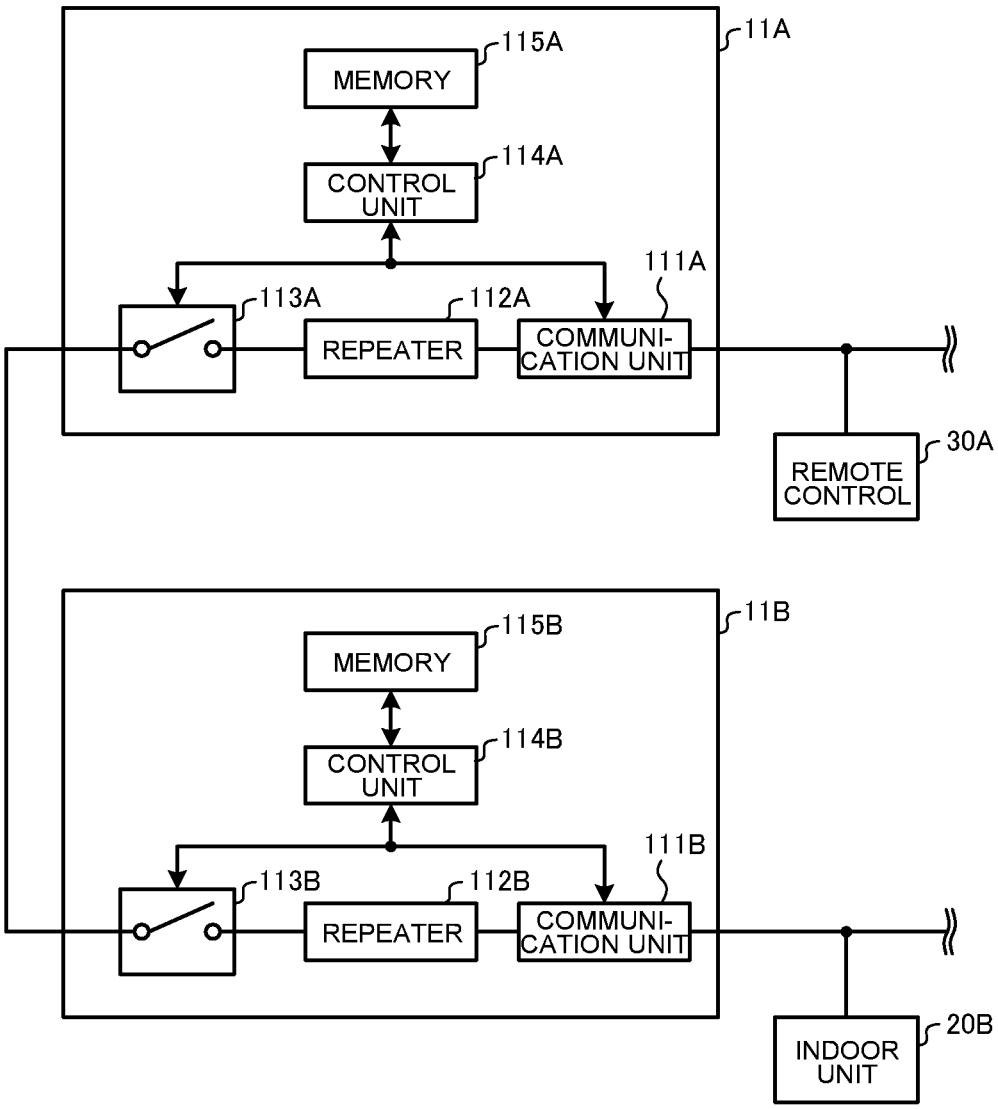
FIG. 2 is a block diagram showing examples of configurations of communication control devices of FIG. 1.

FIG. 2 is a block diagram showing examples of configurations of the communication control devices 11A and 11B of FIG. 1. As shown in FIG. 2, the communication control device 11A includes a communication unit 111A, a repeater 112A, a switch 113A, a control unit 114A, and a memory 115A. Further, the communication control device 11B includes a communication unit 111B, a repeater 112B, a switch 113B, a control unit 114B, and a memory 115B. As the communication control devices 11A and 11B have similar configurations, the following describes the communication control device 11A as an example.

The communication unit 111A is an interface through which to perform communication with pieces of facility equipment such as the indoor units 20A and the remote control 30A, which are provided in the air-conditioning apparatus 1A, via the transmission line 3. The communication unit 111A transmits a received signal to a transmission destination in accordance with control by the control unit 114A.

The repeater 112A relays a signal received via the transmission line 3. Specifically, the repeater 112A transmits, to the centralized management apparatus 2 or the other air-conditioning apparatus 1B, a signal received from a piece of facility equipment by the communication unit 111A via the transmission line 3. Further, the repeater 112A transmits, to a piece of facility equipment via the communication unit 111A, a signal received from the centralized management apparatus 2 or the other air-conditioning apparatus 1B via the transmission line 3.

Furthermore, the repeater 112A is configured to correctly shape the waveform of a received signal. A signal that is transmitted by the transmission line 3 may have its waveform deformed by superimposition of noise during transmission. In such a case, the repeater 112A removes the noise superimposed on the signal and shapes the waveform of the signal into a signal waveform that is equal to the waveform of the signal at the time of transmission. This reduces a transmission error caused during transmission of the signal to a transmission destination.

Although the repeater 112A has been described as being built in the communication control device 11A, this does not impose any limitation. For example, the repeater 112A may be provided outside the communication control device 11A.

The switch 113A is provided between the repeater 112A and the transmission line 3 connected to the centralized management apparatus 2 and the other air-conditioning apparatus 1B. The switch 113A blocks and relays a signal by having its contact point opened and closed in accordance with control by the control unit 114A.

The control unit 114A controls the communication unit 111A and the switch 113A to control communication in the outdoor unit 10A. For example, the control unit 114A controls the opening and closing of the switch 113A by interpreting a communication command contained in a signal received via the communication unit 111A and gives a communication instruction to the communication unit 111A. The control unit 114A implements various types of function by executing software on an arithmetic unit such as a microcomputer or is composed, for example, of hardware such as a circuit device that implements various types of function.

The memory 115A is composed, for example, of a non-volatile memory, and has stored in advance therein, for example, a program for controlling the outdoor unit 10A. Further, in Embodiment 1, the memory 115A has stored in advance therein class information indicating a class of the repeater 112A. The class information is information that contains the frequency of a signal that the repeater 112A or 112B can handle. Further, various types of data are stored in the memory 115A in accordance with control by the control unit 114A.

(Remote Control 30A)

The remote control 30A of FIG. 1 is used in operating the air-conditioning apparatus 1A. The remote control 30A transmits an operation signal corresponding to a user's operation to the outdoor unit 10A and the indoor unit 20A via the transmission line 3.

Further, in Embodiment 1, the remote control 30A can also operate the other air-conditioning apparatus 1B as well as the air-conditioning apparatus 1A, in which the remote control 30A is provided. That is, the remote control 30A can also transmit an operation signal to the outdoor unit 10B and the indoor unit 20B.

[Data Structure of Signal]

Figure 3:
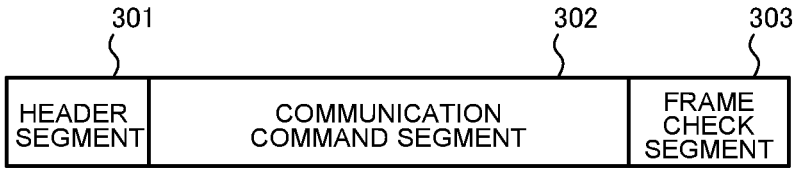
FIG. 3 is a schematic view showing an example of a data structure of a signal that flows through a transmission line.

A description is given of a data structure of a signal that one piece of facility equipment transmits or receives to or from another piece of equipment via the transmission line 3. FIG. 3 is a schematic view showing an example of a data structure of a signal that flows through the transmission line 3. As shown in FIG. 3, the signal is composed of a header segment 301, a communication command segment 302, and a frame check segment 303.

The header segment 301 has stored therein address information, such as a source address and a destination address, for identifying a piece of facility equipment and information indicating the message length of information stored in the communication command segment 302. A transmission address that is designated at this point in time is one that corresponds to a particular piece of facility equipment but may instead be one that corresponds to all pieces of facility equipment.

The communication command segment 302 has stored therein information pertaining to a communication command. Specifically, for example, the communication command segment 302 has stored therein an instruction for monitoring a state of a piece of facility equipment and information for controlling a piece of facility equipment. The frame check segment 303 has stored therein, for example, a code for detecting a transmission error caused during transmission or reception of the signal. Further, in Embodiment 1, the communication command segment 302 has stored therein the class information of the repeater 112A or 112B.

[Operation of Air-Conditioning System 100]

Operation of the air-conditioning system 100 is described below. In Embodiment 1, the remote control 30A or 30B provided in one air-conditioning apparatus 1A or 1B can be used to operate the outdoor unit 10B or 10A and the indoor unit 20B or 20A of the other air-conditioning apparatus 1B or 1A. That is, in Embodiment 1, the air-conditioning apparatus 1A and the air-conditioning apparatus 1B can transmit and receive a signal to and from each other via the transmission line 3.

In this case, a signal that the air-conditioning apparatus 1A and the air-conditioning apparatus 1B transmit and receive to and from each other is relayed by use of the repeaters 112A and 112B of the outdoor units 10A and 10B provided in the respective air-conditioning apparatuses 1A and 1B.

To ensure upward compatibility, the repeaters 112A and 112B can handle a first signal of a standard frequency that is an at least standard frequency. Meanwhile, there is a case where the frequency of a signal other than the first signal that the repeaters 112A and 112B can handle is set in advance, and the frequency of the signal that is handled in this case varies depending on the respective classes of the repeaters 112A and 112B.

The following describes states of signals at the time of transmission in a case where the first signal, whose frequency is compatible with the air-conditioning apparatuses 1A and 1B in common, is used and a case where a second signal whose frequency is compatible only with either the air-conditioning apparatus 1A or 1B is used.

Figure 4:
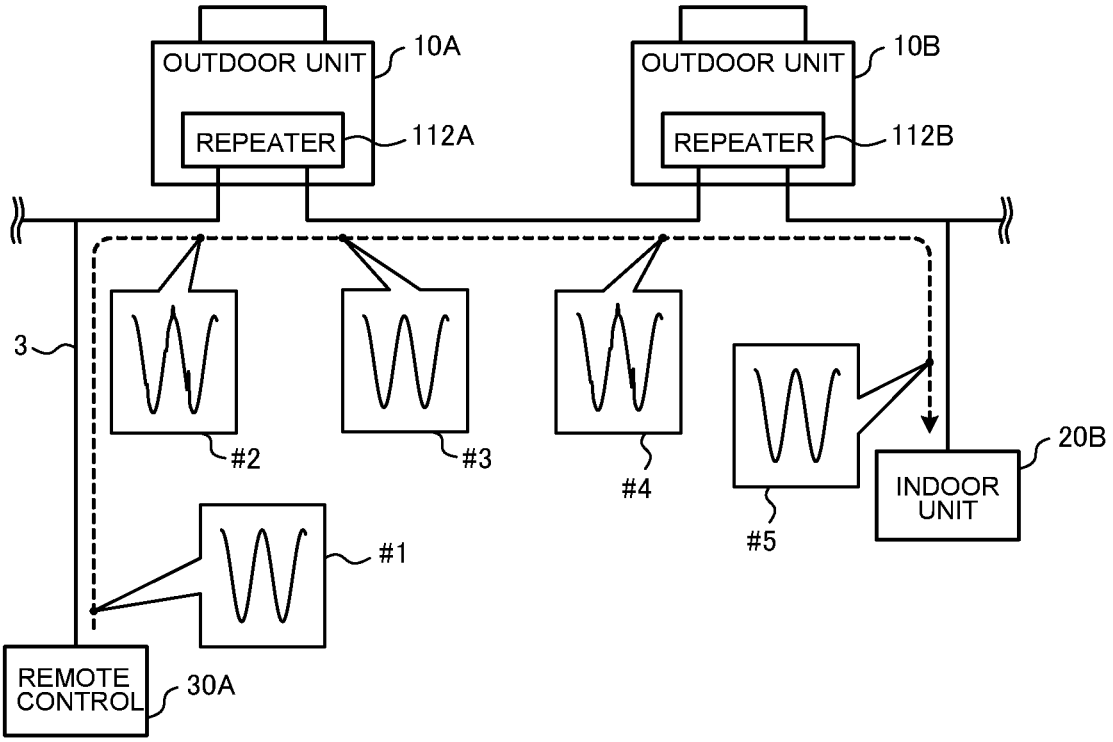
FIG. 4 is a schematic view for explaining a signal state of each component in a case where air-conditioning apparatuses transmit and receive a first signal to and from each other.

FIG. 4 is a schematic view for explaining a signal state of each component in a case where the air-conditioning apparatus 1A and the air-conditioning apparatus 1B transmit and receive the first signal to and from each other. FIG. 4 illustrates an example of a case where an operation signal is transmitted by use of the first signal from the remote control 30A of the air-conditioning apparatus 1A to the indoor unit 20B of the air-conditioning apparatus 1B. The first signal is a signal of the standard frequency, and can be handled by both the air-conditioning apparatus 1A and the air-conditioning apparatus 1B.

In this example, the operation signal is transmitted by use of the first signal from the remote control 30A, and the operation signal thus transmitted is relayed by the outdoor units 10A and 10B and received by the indoor unit 20B. As shown in FIG. 4, a signal waveform #1 represents a state of the first signal just transmitted from the remote control 30A.

A signal waveform #2 represents a state of the first signal about to be received by the repeater 112A of the outdoor unit 10A. The signal waveform #2 is more deformed than the signal waveform #1 by noise superimposed during passage through the transmission line 3. A signal waveform #3 represents a state of the first signal just transmitted after being relayed by the repeater 112A. The signal waveform #3, from which the noise is removed by the repeater 112A, is shaped into a waveform that is equal to the signal waveform #1.

A signal waveform #4 represents a state of the first signal about to be received by the repeater 112B of the outdoor unit 10B. The signal waveform #4 is more deformed than the signal waveform #3 by noise superimposed during passage through the transmission line 3. A signal waveform #5 represents a state of the first signal, transmitted after being relayed by the repeater 112B, which is about to be received by the indoor unit 20B. The signal waveform #5, from which the noise is removed by the repeater 112B, is shaped into a waveform that is equal to the signal waveform #3.

Thus, in a case where the first signal is used as a signal that the air-conditioning apparatus 1A and the air-conditioning apparatus 1B transmit and receive to and from each other, the first signal is properly relayed by the repeaters 112A and 112B. Therefore, the operation signal transmitted from the remote control 30A can be properly received by the indoor unit 20B with the removal of the noise superimposed during transmission through the transmission line 3.

Figure 5:
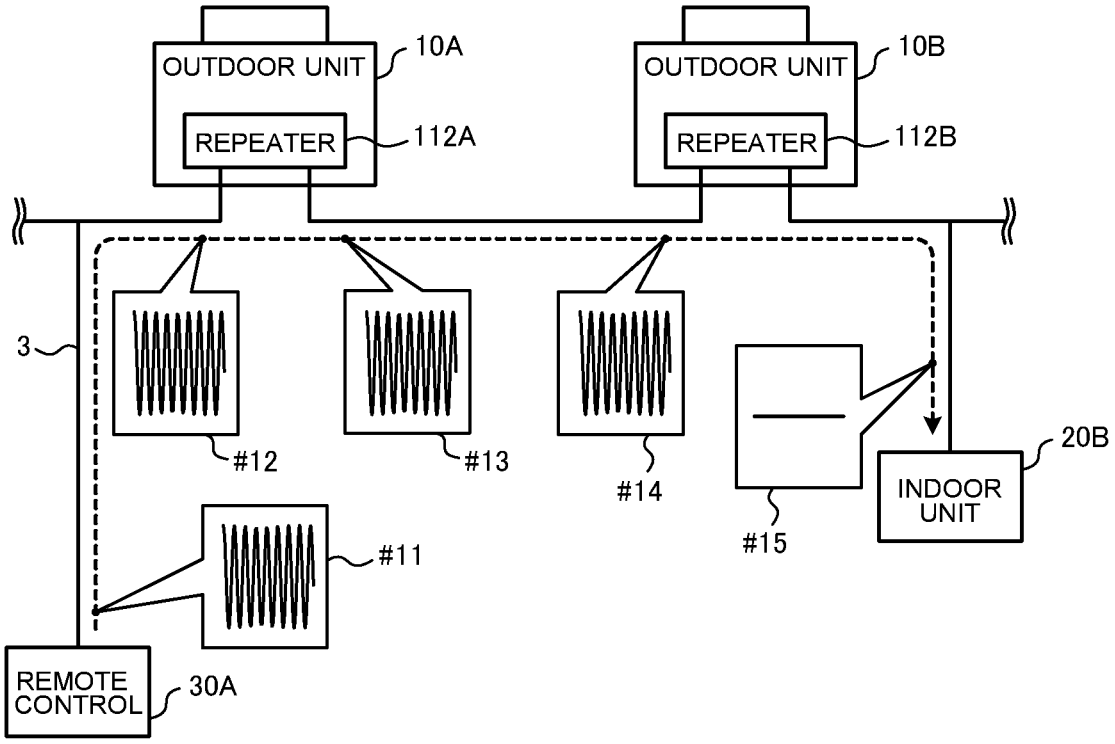
FIG. 5 is a schematic view for explaining a signal state of each component in a case where the air-conditioning apparatuses transmit and receive a second signal to and from each other.

FIG. 5 is a schematic view for explaining a signal state of each component in a case where the air-conditioning apparatus 1A and the air-conditioning apparatus 1B transmit and receive the second signal to and from each other. As in the case with the example shown in FIG. 4, FIG. 5 illustrates an example of a case where an operation signal is transmitted from the remote control 30A of the air-conditioning apparatus 1A to the indoor unit 20B of the air-conditioning apparatus 1B. Note, however, that the operation signal is transmitted from the remote control 30A by use of the second signal, which is different from the first signal.

The second signal is a signal having a frequency that is different from the frequency of the first signal, and has, for example, a higher frequency than does the first signal. Specifically, in the example shown in FIG. 5, the second signal is a signal having twice as high a frequency as the first signal. For this reason, the second signal transfers twice as large an amount of data per unit time as the first signal.

Further, the second signal can be handled only by the air-conditioning apparatus 1A. That is, while the repeater 112A of the air-conditioning apparatus 1A can relay the second signal, the repeater 112B of the air-conditioning apparatus 1B cannot relay the second signal.

In the example shown in FIG. 5, the operation signal is transmitted by use of the second signal from the remote control 30A, and the operation signal thus transmitted is relayed by the outdoor units 10A and 10B and received by the indoor unit 20B. As shown in FIG. 5, a signal waveform #11 represents a state of the second signal just transmitted from the remote control 30A.

A signal waveform #12 represents a state of the second signal about to be received by the repeater 112A of the outdoor unit 10A. The signal waveform #2 is more deformed than the signal waveform #11 by noise superimposed during passage through the transmission line 3. A signal waveform #13 represents a state of the second signal just transmitted after being relayed by the repeater 112A. The signal waveform #13, from which the noise is removed by the repeater 112A, is shaped into a waveform that is equal to the signal waveform #11. A signal waveform #14 represents a state of the second signal about to be received by the repeater 112B of the outdoor unit 10B. The signal waveform #14 is more deformed than the signal waveform #13 by noise superimposed during passage through the transmission line 3.

A signal waveform #15 represents a state of the second signal transmitted after being relayed by the repeater 112B and about to be received by the indoor unit 20B. At this point in time, the repeater 112B is not compatible with the frequency of the second signal. Therefore, the repeater 112B relays the received signal while determining that all frequency components of the received signal represented by the signal waveform #14 are noise. For this reason, the signal waveform #15 is a signal waveform from which all frequency components have been removed.

Thus, in a case where the second signal is used as a signal that the air-conditioning apparatus 1A and the air-conditioning apparatus 1B transmit and receive to and from each other, the second signal is not properly relayed by the repeater 112B. Therefore, the operation signal transmitted from the remote control 30A cannot be properly received by the indoor unit 20B.

In a case where the repeaters 112A and 112B, which are present on the transmission line 3, are different in class from each other and compatible with signals that are different in frequency from each other, the air-conditioning apparatus 1A and the air-conditioning apparatus 1B cannot properly transmit and receive a signal to and from each other, depending on the frequency of the signal. Therefore, in such a case, it is necessary to transmit the signal to a transmission destination by use of a frequency that is common to the air-conditioning apparatuses 1A and 1B.

To this end, Embodiment 1 performs a repeater identification process of identifying the classes of the repeaters 112A and 112B, which are present on the transmission line 3, when the air-conditioning apparatus 1A and the air-conditioning apparatus 1B transmit and receive a signal to and from each other.

(Repeater Identification Process)

Figure 6:
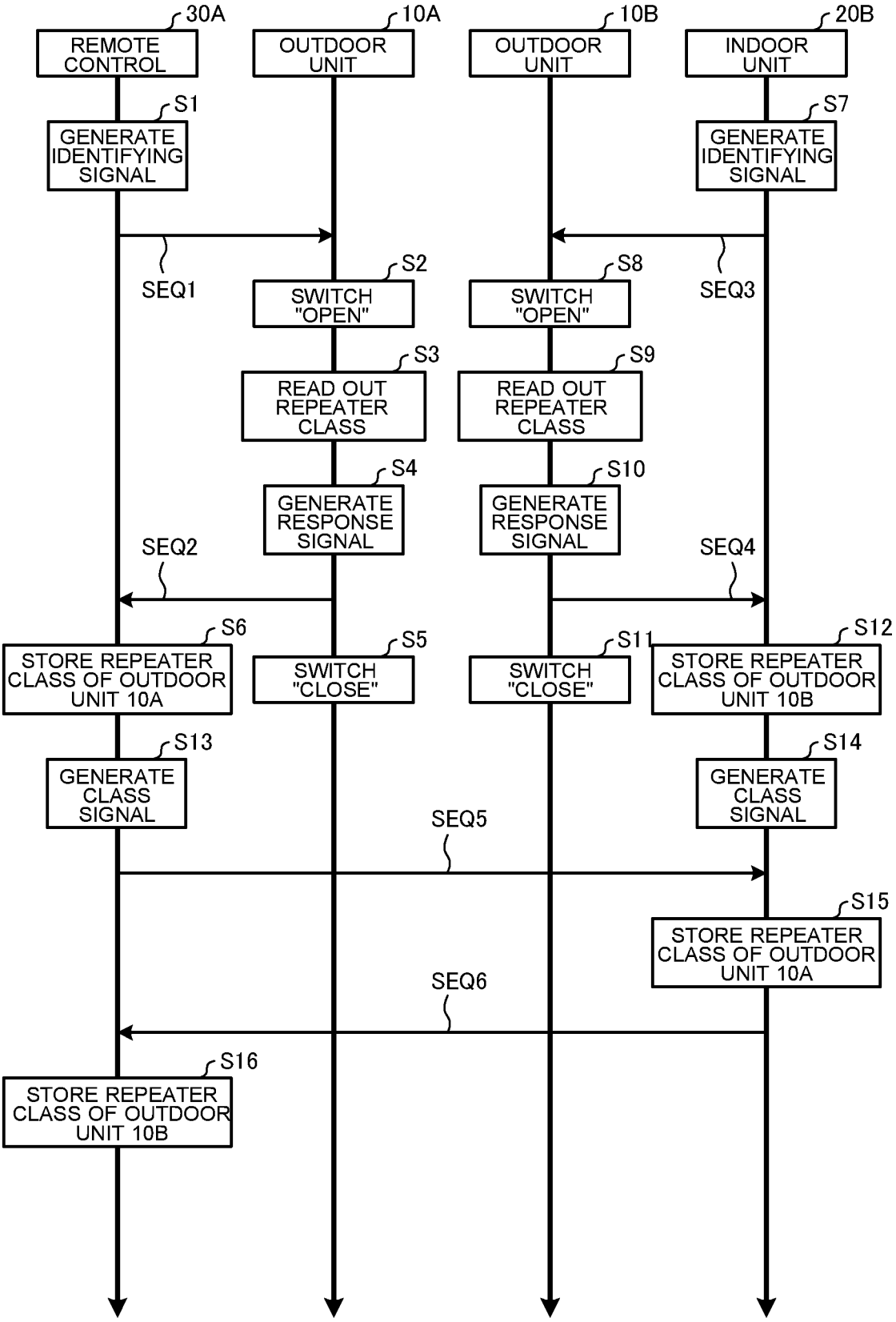
FIG. 6 is a sequence diagram showing an example of the flow of a repeater identification process in the air-conditioning system according to Embodiment 1.

FIG. 6 is a sequence diagram showing an example of the flow of a repeater identification process in the air-conditioning system 100 according to Embodiment 1. FIG. 6 illustrates an example of a case where the remote control 30A of the air-conditioning apparatus 1A and the indoor unit 20B of the air-conditioning apparatus 1B transmit and receive signals to and from each other.

In step S1, at the time of startup, the remote control 30A generates an identifying signal for identifying the repeater 112A of the outdoor unit 10A. The header segment 301 of the identifying signal at this point in time has all addresses set therein as destination addresses. Further, the communication command segment 302 has stored therein request information for requesting the class of the repeater 112A.

In sequence SEQ1, the identifying signal generated in step S1 is transmitted from the remote control 30A to the outdoor unit 10A. The identifying signal is transmitted by use of the first signal, which can be relayed by a repeater regardless of the class of the repeater. The identifying signal transmitted from the remote control 30A is received by the control unit 114A via the communication unit 111A of the outdoor unit 10A.

In step S2, upon receiving the identifying signal and recognizing that the communication command segment 302 of the identifying signal has the request information stored therein, the control unit 114A controls the switch 113A in such a manner that the switch 113A is brought into an open state. As a result of this, the communication is blocked so that the identifying signal is not relayed to the air-conditioning apparatus 1B. In step S3, on the basis of the request information stored in the communication command segment 302 of the identifying signal, the control unit 114A reads out class information of the repeater 112A stored in the memory 115A.

In step S4, the control unit 114A generates a response signal whose communication command segment 302 has stored therein the class information thus read out. The header segment 301 of the response signal has an address of the remote control 30A set therein as a destination address. In sequence SEQ2, the response signal generated in step S4 is transmitted to the remote control 30A via the communication unit 111A. In step S5, after completing a response by transmitting the response signal, the control unit 114A controls the switch 113A in such a manner that the switch 113A is brought into a closed state.

In step S6, upon receiving the response signal, the remote control 30A stores, in a nonvolatile memory (not illustrated), the class information of the repeater 112A of the outdoor unit 10A stored in the communication command segment 302 of the response signal thus received.

Meanwhile, in step S7, at the time of startup, the indoor unit 20B generates an identifying signal for identifying the repeater 112B of the outdoor unit 10B. The header segment 301 of the identifying signal at this point in time has all addresses set therein as destination addresses. Further, the communication command segment 302 has stored therein request information for requesting the class of the repeater 112B.

In sequence SEQ3, the identifying signal generated in step S7 is transmitted from the indoor unit 20B to the outdoor unit 10B. The identifying signal is transmitted by use of the first signal. The identifying signal transmitted from the indoor unit 20B is received by the control unit 114B via the communication unit 111B of the outdoor unit 10B.

In step S8, upon receiving the identifying signal and recognizing that the communication command segment 302 of the identifying signal has the request information stored therein, the control unit 114B controls the switch 113B in such a manner that the switch 113B is brought into an open state. As a result of this, the communication is blocked so that the identifying signal is not relayed to the air-conditioning apparatus 1A. In step S9, on the basis of the request information stored in the communication command segment 302 of the identifying signal, the control unit 114B reads out class information of the repeater 112B stored in the memory 115B.

In step S10, the control unit 114B generates a response signal whose communication command segment 302 has stored therein the class information thus read out. The header segment 301 of the response signal has an address of the indoor unit 20B set therein as a destination address. In sequence SEQ4, the response signal generated in step S10 is transmitted to the indoor unit 20B via the communication unit 111B. In step S11, after completing a response by transmitting the response signal, the control unit 114B controls the switch 113B in such a manner that the switch 113B is brought into a closed state.

In step S12, upon receiving the response signal, the indoor unit 20B stores, in a nonvolatile memory (not illustrated), the class information of the repeater 112B of the outdoor unit 10B stored in the communication command segment 302 of the response signal thus received.

Next, in step S13, the control unit 114A of the remote control 30A generates a class signal whose communication command segment 302 has stored therein the class information of the repeater 112A stored in step S6. The header segment 301 of the class signal has the address of the indoor unit 20B set therein as a destination address.

Further, in step S14, the control unit 114B of the indoor unit 20B generates a class signal whose communication command segment 302 has stored therein the class information of the repeater 112B stored in step S12. The header segment 301 of the class signal has the address of the remote control 30A set therein as a destination address.

In sequence SEQ5, the class signal generated in step S13 is transmitted to the indoor unit 20B via the outdoor units 10A and 10B. The class signal is transmitted by use of the first signal. In step S15, upon receiving the class signal, the indoor unit 20B stores, in the nonvolatile memory, the class information of the repeater 112A of the outdoor unit 10A stored in the communication command segment 302 of the class signal.

In sequence SEQ6, the class signal generated in step S14 is transmitted to the remote control 30A via the outdoor units 10B and 10A. The class signal is transmitted by use of the first signal. In step S16, upon receiving the class signal, the remote control 30A stores, in the nonvolatile memory, the class information of the repeater 112A of the outdoor unit 10A stored in the communication command segment 302 of the class signal.

In the example thus described, the processes in sequence SEQ6 and step S16 are executed after the processes in sequence SEQ5 and step S15 have been executed. However, this is not intended to impose any limitation. The order of the processes in sequence SEQ6 and step S16 and the processes in sequence SEQ5 and step S15 may be reversed. Alternatively, the processes in sequence SEQ6 and step S16 and the processes in sequence SEQ5 and step S15 may be simultaneously executed.

In this manner, the remote control 30A and the indoor unit 20B can recognize the classes of the repeaters that are present on the transmission line 3 via which the remote control 30A and the indoor unit 20B transmit and receive signals to and from each other. After that, in a case where the remote control 30A and the indoor unit 20B transmit and receive signals to and from each other, the signals are transmitted and received by use of a signal of a frequency that is most suitable of the frequencies with which the repeaters on the transmission line 3 are compatible.

For example, in a case where the repeaters 112A and 112B, which are present on the transmission line 3 between the remote control 30A and the indoor unit 20B, are compatible only with the frequency of the first signal, the remote control 30A and the indoor unit 20B perform transmission and reception by way of the first signal. Alternatively, in a case where the repeaters 112A and 112B, which are present on the transmission line 3 between the remote control 30A and the indoor unit 20B, are compatible with the frequency of the second signal, the remote control 30A and the indoor unit 20B perform transmission and reception by way of the second signal.

As noted above, in the air-conditioning system 100 according to Embodiment 1, in a case where a frequency with which the repeater 112A is compatible and a frequency with which the repeater 112B is compatible match, the remote control 30A and the indoor unit 20B perform communication by use of a signal of the frequency thus matching. This makes it possible to properly perform communication even in a case where there is in the system a mixture of apparatuses that are compatible with different frequencies, that is, that are different in communication method from each other.

Further, in the air-conditioning system 100, the remote control 30A acquires the class information of the repeater 112A from the outdoor unit 10A, and the indoor unit 20B acquires the class information of the repeater 112B from the outdoor unit 10B. As a result of this, the frequency of a signal to be transmitted and received is determined on the basis of the class information thus acquired. This makes it possible to perform communication without replacing repeaters.

Furthermore, in the air-conditioning system 100, the remote control 30A transmits the class information of the repeater 112A to the indoor unit 20B by way of a signal of a standard frequency, and the indoor unit 20B transmits the class information of the repeater 112B to the remote control 30A by way of the signal of the standard frequency. This allows the remote control 30A and the indoor unit 20B to grasp the classes of the repeaters of each other's communication partners.

Moreover, in the air-conditioning system 100, the control unit 114A brings the switch 113A into an open state upon receiving from the remote control 30A an identifying signal for requesting the class information of the repeater 112A. This blocks the communication so that the identifying signal is not relayed to the air-conditioning apparatus 1B.

Moreover, the control unit 114B brings the switch 113B into an open state upon receiving from the indoor unit 20B an identifying signal for requesting the class information of the repeater 112B. This blocks the communication so that the identifying signal is not relayed to the air-conditioning apparatus 1A.

Furthermore, in the air-conditioning system 100, the set frequency is a frequency that is higher than the standard frequency. As a result of this, the amount of data that is transferred per unit time in a case where the set frequency is used can be made larger than that in a case where the standard frequency is used.

Embodiment 2

Next, Embodiment 2 of the present disclosure is described. Embodiment 2 differs from Embodiment 1 in terms of a configuration of a communication control device provided in an outdoor unit. In the following description, components that are identical to those of Embodiment 1 are given the same reference signs and are not described in detail.

[Configuration of Communication Control Device 120A]

Figure 7:
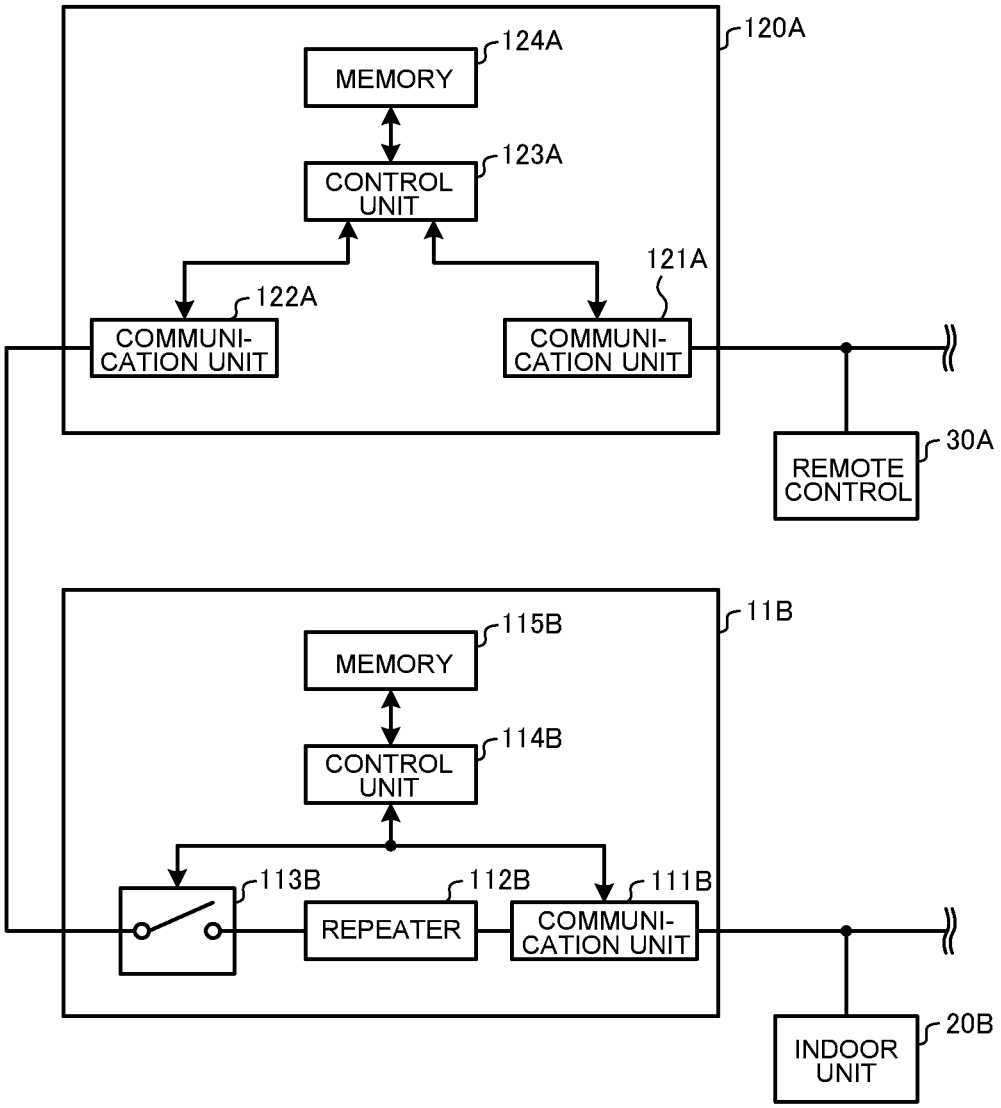
FIG. 7 is a block diagram showing examples of configurations of communication control devices of outdoor units according to Embodiment 2.

FIG. 7 is a block diagram showing an example of a configuration of a communication control device 120A of an outdoor unit 10A and an example of a configuration of a communication control device 11B of an outdoor unit 10B according to Embodiment 2. As shown in FIG. 7, the communication control device 120A includes communication units 121A and 122A, a control unit 123A, and a memory 124A. Further, as in the case with Embodiment 1, the communication control device 11B includes a communication unit 111B, a repeater 112B, a switch 113B, a control unit 114B, and a memory 115B.

The communication unit 121A is an interface through which to perform communication with pieces of facility equipment such as the indoor units 20A and the remote control 30A, which are provided in the air-conditioning apparatus 1A, via the transmission line 3. The communication unit 121A supplies the control unit 123A with a signal received from a piece of facility equipment. Further, the communication unit 121A transmits, to a piece of facility equipment, a signal supplied from the control unit 123A.

The communication unit 122A is an interface through which to perform communication with the centralized management apparatus 2 or the air-conditioning apparatus 1B via the transmission line 3. The communication unit 122A supplies the control unit 123A with a signal received from the centralized management apparatus 2 or the air-conditioning apparatus 1B. Further, the communication unit 122A transmits, to the centralized management apparatus 2 or the air-conditioning apparatus 1B, a signal supplied from the control unit 123A.

The communication units 121A and 122A convert the frequencies of received signals into given frequencies in accordance with control by the control unit 123A.

The control unit 123A controls the communication units 121A and 122A to control communication in the outdoor unit 10A. For example, the control unit 123A controls the communication unit 122A in such a manner that the communication unit 122A is supplied with a signal received by the communication unit 121A and the signal is transmitted with its frequency converted as needed. Further, the control unit 123A controls the communication unit 121A in such a manner that the communication unit 121A is supplied with a signal received by the communication unit 122A and the signal is transmitted with its frequency converted as needed. The control unit 123A implements various types of function by executing software on an arithmetic unit such as a microcomputer or is composed, for example, of hardware such as a circuit device that implements various types of function.

The memory 124A is composed, for example, of a non-volatile memory, and has stored in advance therein, for example, a program for controlling the outdoor unit 10A. The memory 124A writes and reads out, in accordance with control by the control unit 123A, various types of information stored therein. Further, in Embodiment 2, the memory 124A stores, in accordance with control by the control unit 123A, class information that is supplied during a transmission process and that indicates the class of the repeater 112B.

[Operation of Air-Conditioning System 100]

Operation of an air-conditioning system 100 is described below. In the air-conditioning system 100 according to Embodiment 2, the air-conditioning apparatus 1A and the air-conditioning apparatus 1B transmit and receive a signal to and from each other via the transmission line 3, as in the case with Embodiment 1.

Figure 8:
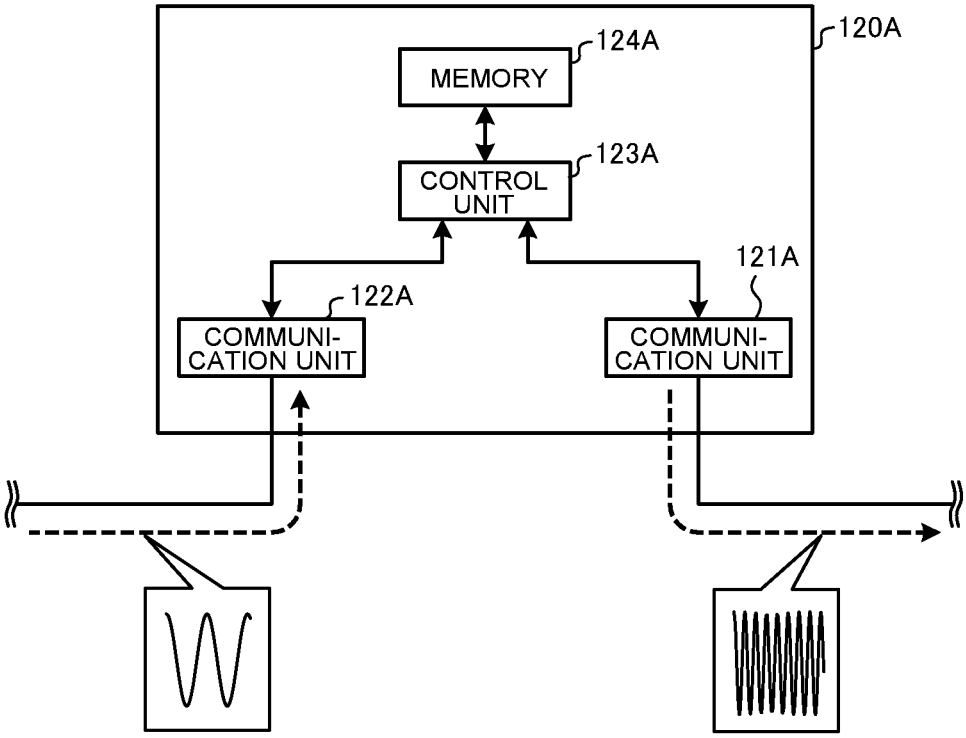
FIG. 8 is a schematic view for explaining operation of a communication control device according to Embodiment 2.

FIG. 8 is a schematic view for explaining operation of the communication control device 120A according to Embodiment 2. FIG. 8 illustrates an example of a case where a signal received via the communication unit 122A is transmitted via the communication unit 121A.

As shown in FIG. 8, when a signal transmitted by use of the first signal is received by the communication control device 120A of the outdoor unit 10A of the air-conditioning apparatus 1A, the signal thus received is supplied to the control unit 123A via the communication unit 122A. To transmit the signal thus supplied to a transmission destination, the control unit 123A supplies the signal to the communication unit 121A.

At this point in time, the control unit 123A controls the communication unit 121A in such a manner that the frequency of the signal is converted in consideration of the frequency with which the repeater of the destination apparatus is compatible. As a result of this, the communication unit 121A converts the frequency of the signal supplied from the control unit 123A. Then, the communication unit 121A transmits the signal, whose frequency has been converted, to the transmission destination. In this example, a low-frequency signal is converted into a high-frequency signal. This is not intended to impose any limitation. For example, a high-frequency signal may be converted into a low-frequency signal.

Note here that depending on the frequency of the signal that is transmitted to the transmission destination, the destination apparatus cannot correctly receive the signal. Therefore, the control unit 123A needs to convert the frequency of the signal into the frequency with which the repeater of the destination apparatus is compatible. To this end, Embodiment 2 performs a repeater identification process to recognize the frequency with which the repeater of the destination apparatus is compatible.

(Repeater Identification Process)

Figure 9:
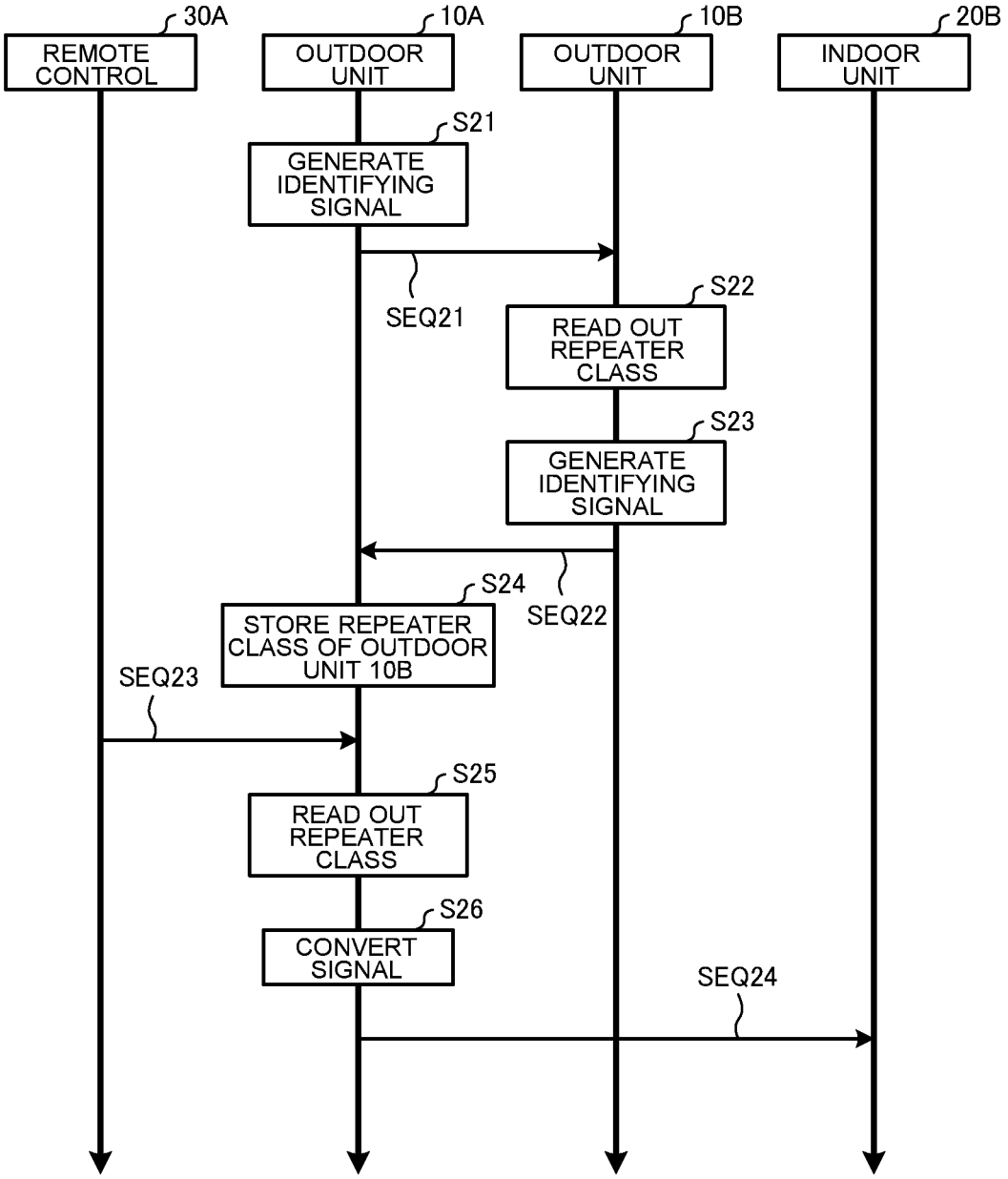
FIG. 9 is a sequence diagram showing an example of the flow of a repeater identification process in an air-conditioning system according to Embodiment 2.

FIG. 9 is a sequence diagram showing an example of the flow of a repeater identification process in the air-conditioning system 100 according to Embodiment 2. FIG. 9 illustrates an example of a case where the remote control 30A of the air-conditioning apparatus 1A and the indoor unit 20B of the air-conditioning apparatus 1B transmit and receive signals to and from each other.

In step S21, at the time of startup, the outdoor unit 10A of the air-conditioning apparatus 1A generates an identifying signal for the control unit 123A to identify the repeater 112B of the outdoor unit 10B. The header segment 301 of the identifying signal has an address of the outdoor unit 10B set therein as a destination address. The communication command segment 302 has stored therein request information for requesting the class of the repeater 112B.

In sequence SEQ21, the identifying signal generated in step S21 is transmitted from the outdoor unit 10A to the outdoor unit 10B. At this point in time, the identification signal may be a signal of any frequency as long as the communication unit 122A of the outdoor unit 10A is compatible with the frequency.

In step S22, the control unit 114B receives the identifying signal via the communication unit 122A and, on the basis of the request information stored in the communication command segment 302 of the identifying signal thus received, reads out the class information of the repeater 112B stored in the memory 115B. In step S23, the control unit 114B generates a response signal whose communication command segment 302 has stored therein the class information thus read out. The header segment 301 of the response signal has an address of the outdoor unit 10A set therein as a destination address.

In sequence SEQ22, the response signal generated in step S23 is transmitted to the control unit 123A via the communication unit 122A of the outdoor unit 10A. In step S24, upon receiving the response signal, the control unit 123A stores, in the memory 124A, the class information of the repeater 112B of the outdoor unit 10B stored in the communication command segment 302 of the response signal thus received.

After the control unit 123A of the outdoor unit 10A has thus recognized the class of the repeater 112B of the indoor unit 20B, a signal to be transmitted, such as an operation signal, is transmitted from the remote control 30A to the indoor unit 20B in sequence SEQ23. The header segment 301 of the signal has the address of the indoor unit 20B set therein as a destination address. Further, the signal that is transmitted at this point in time may be a signal of any frequency as long as the communication unit 122A of the outdoor unit 10A is compatible with the frequency.

In step S25, the control unit 123A of the outdoor unit 10A receives, via the communication unit 121A, the signal transmitted from the remote control 30A. Upon receiving the signal, the control unit 123A determines that the destination address set in the header segment 301 of the signal indicates the indoor unit 20B, and reads out the class information of the repeater 112B of the outdoor unit 10B stored in the memory 124A.

In step S26, on the basis of the class information thus read out of the repeater 112B, the control unit 123A controls the communication unit 122A in such a manner that the frequency of the signal thus received is converted into the frequency with which the repeater 112B is compatible. As a result of this, the communication unit 122A converts the frequency of the signal. Then, in sequence SEQ24, the signal converted in step S26 is transmitted to the indoor unit 20B via the outdoor unit 10B.

In this manner, the outdoor unit 10A can recognize the class of a repeater that is present on the transmission line 3 via which to transmit and receive signals. After that, in a case where the remote control 30A and the indoor unit 20B transmit and receive signals to and from each other, the signals are transmitted and received by use of a signal of a frequency that is most suitable of the frequencies with which the repeaters on the transmission line 3 are compatible.

For example, in a case where the repeater 112B, which is present on the transmission line 3 between the remote control 30A and the indoor unit 20B, is compatible only with the frequency of the first signal, the remote control 30A and the indoor unit 20B perform transmission and reception by way of the first signal. Alternatively, in a case where the repeater 112B, which is present on the transmission line 3 between the remote control 30A and the indoor unit 20B, is compatible with the frequency of the second signal, the remote control 30A and the indoor unit 20B perform transmission and reception by way of the second signal.

As noted above, in the air-conditioning system 100 according to Embodiment 2, the communication unit 122A of the outdoor unit 10A converts the frequency of a signal received from the remote control 30A into the frequency with which the repeater 112B is compatible, and transmits the signal thus converted to the indoor unit 20B. As in the case with Embodiment 1, this makes it possible to properly perform communication even in a case where there is in the system a mixture of apparatuses that are different in communication method from each other.

Further, in the air-conditioning system 100, the outdoor unit 10A acquires the class information of the repeater 112B stored in the memory 115B. This allows the outdoor unit 10A to grasp the frequency with which the repeater 112B of the air-conditioning apparatus 1B, to which the signal is transmitted as the transmission destination, is compatible, thus making it possible to properly perform communication with the air-conditioning apparatus 1B.

Further, in the air-conditioning system 100, upon receiving a signal from the remote control 30A to the indoor unit 20B, the communication unit 121A of the outdoor unit 10A converts the frequency of the signal thus received into a set frequency contained in the class information thus acquired of the repeater 112B. As in the case with Embodiment 1, this makes it possible to properly perform communication even in a case where there is in the system a mixture of apparatuses that are different in communication method from each other.

Moreover, in the air-conditioning system 100, the set frequency is higher than the frequency of the signal received from the remote control 30A. As in the case with Embodiment 1, this makes it possible to increase the amount of data that is transferred per unit time.

REFERENCE SIGNS LIST

1A, 1B air-conditioning apparatus 2 centralized management apparatus 3 transmission line 4A, 4B refrigerant pipe 10A, 10B outdoor unit 11A, 11B, 120A communication control device 20A, 20B indoor unit 30A, 30B remote controller 100 air-conditioning system 111A, 111B, 121A, 122A communication unit 112A, 112B repeater 113A, 113B switch 114A, 114B, 123A control unit 115A, 115B, 124A memory 301 header segment 302 communication command segment 303 frame check segment

The invention claimed is:

1. An air-conditioning system, comprising:

a plurality of air-conditioning apparatuses each including an outdoor unit, an indoor unit, and a remote controller; and a transmission line via which the plurality of air-conditioning apparatuses are connected to each other, each of the outdoor units including a communication unit configured to transmit and receive a signal, a repeater configured to relay a signal of a set frequency, and a memory configured to store class information of the repeater, the class information containing a set frequency with which the repeater is compatible, the remote controller of one air-conditioning apparatus of the plurality of air-conditioning apparatuses being configured to acquire the class information of the repeater of the one air-conditioning apparatus, the class information of the repeater of the one air-conditioning apparatus being stored in the memory of the one air-conditioning apparatus, the indoor unit of an other air-conditioning apparatus of the plurality of air-conditioning apparatuses being configured to acquire the class information of the repeater of the other air-conditioning apparatus, the class information of the repeater of the other air-conditioning apparatus being stored in the memory of the other air-conditioning apparatus, in a case where, on a basis of the class information of the repeater of the one air-conditioning apparatus and the class information of the repeater of the other air-conditioning apparatus, a set frequency with which the repeater of the one air-conditioning apparatus is compatible and a set frequency with which the repeater of the other air-conditioning apparatus is compatible match, the remote controller of the one air-conditioning apparatus and the indoor unit of the other air-conditioning apparatus being configured to perform communication by use of a signal of the set frequency thus matching, wherein:

the remote controller of the one air-conditioning apparatus is configured to transmit the class information of the repeater of the one air-conditioning apparatus thus acquired to the indoor unit of the other air-conditioning apparatus by way of a signal of a standard frequency, and the indoor unit of the other air-conditioning apparatus is configured to transmit the class information of the repeater of the other air-conditioning apparatus thus acquired to the remote controller of the one air-conditioning apparatus by way of a signal of the standard frequency.

2. The air-conditioning system of claim 1, wherein each of the outdoor units further includes a switch provided between the repeater and the transmission line and configured to block and relay the signal, and a control unit configured to control opening and closing of the switch, the control unit of the one air-conditioning apparatus is configured to bring the switch of the one air-conditioning apparatus into an open state upon receiving, from the remote controller of the one air-conditioning apparatus, an identifying signal for requesting the class information of the repeater of the one air-conditioning apparatus, and the control unit of the other air-conditioning apparatus is configured to bring the switch of the other air-conditioning apparatus into an open state upon receiving, from the indoor unit of the other air-conditioning apparatus, an identifying signal for requesting the class information of the repeater of the other air-conditioning apparatus.

3. The air-conditioning system of claim 1, wherein the set frequency is higher than the standard frequency.

4. An air-conditioning system, comprising:

a plurality of air-conditioning apparatuses each including an outdoor unit, an indoor unit, and a remote controller; and a transmission line via which the plurality of air-conditioning apparatuses are connected to each other, the outdoor unit of one air-conditioning apparatus of the plurality of air-conditioning apparatuses including a communication unit configured to convert a frequency of a received signal and transmit the received signal, the outdoor unit of an other air-conditioning apparatus of the plurality of air-conditioning apparatuses including a communication unit configured to transmit and receive a signal, a repeater configured to relay a signal of a set frequency, and a memory configured to store class information of the repeater, the class information containing the set frequency with which the repeater is compatible, the outdoor unit of the one air-conditioning apparatus being configured to acquire the class information of the repeater thus stored in the memory, the communication unit of the outdoor unit of the one air-conditioning apparatus being configured to convert, on a basis of the class information, a frequency of a signal received from the remote controller of the one air-conditioning apparatus into the set frequency with which the repeater of the other air-conditioning apparatus is compatible, and transmit the signal thus converted to the indoor unit of the other air-conditioning apparatus.

5. The air-conditioning system of claim 4, wherein upon receiving a signal from the remote controller of the one air-conditioning apparatus to the indoor unit of the other air-conditioning apparatus, the communication unit of the outdoor unit of the one air-conditioning apparatus is configured to convert a frequency of the signal thus received into the set frequency contained in the class information thus acquired of the repeater of the other air-conditioning apparatus.

6. The air-conditioning system of claim 4, wherein the set frequency is higher than a frequency of the signal received from the remote controller of the one air-conditioning apparatus.

* * * * *